United States Patent [19]

Krafft et al.

[11] 4,138,260

[45] Feb. 6, 1979

[54] PHOTOGRAPHIC FILM UNIT WITH CROSSLINKED NEUTRALIZATION LAYER

[75] Inventors: Werner Krafft, Leverkusen; Günter Helling, Siegburg, both of Fed. Rep. of Germany

[73] Assignee: Agfa-Gevaert Aktiengesellschaft, Leverkusen, Fed. Rep. of Germany

[21] Appl. No.: 851,310

[22] Filed: Nov. 14, 1977

[30] Foreign Application Priority Data

Nov. 18, 1976 [DE] Fed. Rep. of Germany ..... 2652464

[51] Int. Cl.[2] ..... G03C 1/40; G03C 7/00; G03C 5/54

[52] U.S. Cl. ..... 96/77; 96/3; 96/29 D

[58] Field of Search ..... 96/3, 29 D, 77, 76 R

[56] References Cited

U.S. PATENT DOCUMENTS 3,833,367 9/1974 Haas ..... 96/77

OTHER PUBLICATIONS

"Neutralizing Layer For Color Transfer Assemblage", *Research Disclosure* No. 13525, Jul. 1975.

*Primary Examiner*—Richard L. Schilling
*Attorney, Agent, or Firm*—Connolly and Hutz

[57] ABSTRACT

The neutralization layer (acid polymer layer) in a photographic film unit for the production of colored transfer images contains a crosslinked acrylic or methacrylic acid copolymer having at least 30 mol % of copolymerized acrylic acid or methacrylic acid and the crosslinking has been brought about by copolymerizing said acid monomers or the corresponding esters together with a crosslinking agent having at least two copolymerizable carbon-carbon double bands.

4 Claims, No Drawings

PHOTOGRAPHIC FILM UNIT WITH CROSSLINKED NEUTRALIZATION LAYER

This invention relates to a material for the production of colour photographic images by the dye diffusion transfer process, and in particular a combination of acid polymer layer and barrier layer forming a neutralisation system for such a material, in which the acid polymer layer contains a (meth)acrylic acid copolymer which has at least 30 mol % of (meth)acrylic acid units and which has been cross-linked by copolymerisation.

For carrying out the dye diffusion transfer process, it is customary to use a light-sensitive element containing dye-providing compounds and an image receiving element in which the desired colour image is produced by diffusible dyes which have been transferred imagewise. Firm contact must be established between the light-sensitive element and the image receiving element for at least a finite length of time within the development time so that the imagewise distribution of diffusible dyes produced in the light-sensitive element as a result of development can be transferred to the image receiving element. This contact may be established after development has commenced or it may already have been established before the onset of development. The latter is the case if, for example, a material in which the light-sensitive element and the image receiving element together form an intergral unit is used for carrying out the dye diffusion transfer process. Other embodiments of the dye diffusion transfer process are known, in which such an integral unit is preserved even after completion of the development process, that is to say the light-sensitive element is not separated from the image receiving element even after transfer of the dyes. Such an embodiment of the process has been described, for example, in German Offenlegungsschrift No. 2,019,430. According to an alternative embodiment of the process, the image receiving element which carries the completed image after dye transfer may be separated from the light-sensitive element, for example by means for a separating layer arranged between the two elements. Reference to such an embodiment may be found, for example, in German Offenlegungsschrift No. 2,049,688.

After imagewise exposure, the light-sensitive element is treated with an alkaline developer preparation to develop the silver halide and produce an imagewise distribution of diffusible dyes which are transferred to the image receiving element. This treatment is generally not followed by washing. However, the high pH to which the image receiving layer is adjusted during development must be reduced in order finally to fix the image dyes in the image receiving layer and effectively to terminate development. This is particularly important when the image receiving element and the light-sensitive element together form an integral unit or so-called monosheet. Known measures for lowering the pH consist in arranging a so-called neutralisation system in close spatial relationship to the image receiving layer. This neutralisation system consists of a neutralisation layer containing a polymer having free acid groups and a barrier layer which retards neutralisation and contains a polymer which offers a certain resistance to the diffusible hydroxyl ions. A neutralisation system of this kind has been described, for example, in German Pat. No. 1,285,310.

It is known to use polymeric organic acids for the preparation of the neutralisation layers, preferably in a partially esterified form (U.S. Pat. No. 3,362,819). The solvents used for these polymeric organic acids are organic solvents. This method is obviously expensive and undesirable on ecological grounds. In U.S. Pat. No. 3,756,815, it has been disclosed to produce neutralisation layers composed of water-soluble polymeric acids and water-soluble binders. However, these layers undergo excessive swelling when cast, thus giving rise to difficulties in the subsequent application of the barrier layer. It was observed that the polymer latices used for preparing the barrier layer, such as the latices described in U.S. Pat. No. 3,455,686 and in German Offenlegungsschriften Nos. 2,319,723 and 2,364,137 very rapidly form a comparatively water-impermeable skin when applied to these neutralisation layers and subsequently dried, so that great difficulties are encountered in drying the whole combination of layers. In addition, the latex skin shrinks in the process of drying so that the edges of a web of film which has been coated with the neutralisation layer have comparatively wide strips which are free from latex. It will be clear from this that the bond between the neutralisation layer and the barrier layer leaves something to be desired.

Commercial acid-containing latices generally contain at the most 6 mol % of free organic acid, for example units of acrylic acid, methacrylic acid or maleic acid. Latices containing from 20 to 30 mol % of acrylic acid can only be kept stable to some extent with very large quantities of wetting agents but the high proportion of wetting agent, e.g. more than 10% based on the solid content, results in layers which have insufficient resistance to wet wiping.

It is an object of the present invention to provide film-forming polymers containing acid groups, which polymers can be cast from aqueous dispersions to form optically clear layers which have a high capacity for neutralising hydroxyl ions and undergo little or no swelling with water.

It has now been found that a latex of a cross-linked acrylic acid or methacrylic acid copolymer containing at least 30 mol % of monomeric acid units is particularly suitable for this purpose. By this is meant the latex of a copolymer of acrylic acid or methacrylic acid with a cross-linking agent, i.e. with a monomeric compound having at least two double bonds which are capable of copolymerisation with acrylic or methacrylic acid.

The present invention relates to a photographic film unit for the production of coloured transfer images, containing, on a dimensionally stable, preferably transparent support layer, an image receiving layer, a light-sensitive element comprising at least one light-sensitive silver halide emulsion layer and non-diffusible dye-providing compound associated therewith and a neutralisation element consisting of a layer containing a polymer which has free acid groups (neutralisation layer) and a barrier layer which retards neutralisation. The photographic film unit according to the present invention is characterised in that the neutralisation layer contains an acrylic or methacrylic acid copolymer which has been cross-linked by copolymerisation and which has at least 30 mol %, preferably from 70 to 99 mol % of acrylic or methacrylic acid units. The special advantage of the neutralisation layer according to the invention is that it can be applied in the form of a copolymer latex, i.e. in the form of an aqueous dispersion of the above mentioned copolymer and hence from the aqueous phase, and that the copolymer undergoes little or no swelling with water.

Besides the polymerised units of acrylic acid or methacrylic acid and the polymerised units of a crosslinking agent which are essential constituents of the copolymer of the present invention, the copolymer may also contain other polymerised units of copolymerisable monomers and in particular units selected from the group consisting of alkyl acrylates, cycloalkyl acrylates, alkyl methacrylates, cycloalkyl methacrylates and monomeric units containing a copolymerisable carbon-carbon double bond and a sulfonic acid group.

Latices of copolymers represented by the following general formula are preferably used for preparation of the neutralisation layers:

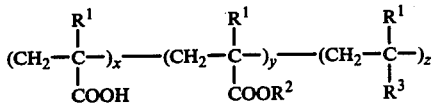

In the above formula, $R^1$ represents hydrogen or an alkyl group preferably a methyl group;

$R^2$ represents an alkyl or cycloalkyl group, preferably an alkyl group with 1 to 4 carbon atoms, such as a methyl, ethyl, n-propyl, isopropyl, n-butyl or tert.-butyl group;

$R^3$ represents the residue of an organic cross-linking compound having at least one other copolymerised or copolymerisable C—C double bond, e.g. an alkyl, cycloalkyl or aryl residue having at least one other copolymerisable or copolymerised C—C double bond;

x, y and z represent the molar proportions of copolymerised monomer in the copolymer (in mol %), as follows:

x = 30 to 99 mol %, preferably 70 to 99 mol %;

y+z = 1 to 70 mol %, preferably 1 to 30 mol %; y may a value from 1–30 mol %.

According to another preferred embodiment of the invention the latex polymer contains small amounts (up to 10 mol %) of polymerised units of copolymerizable monomeric compounds containing a sulfo group and therefore corresponds to the following formula

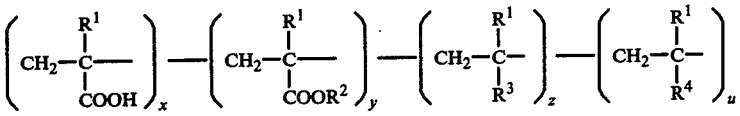

in which $R^1$, $R^2$, $R^3$, x, y and z have the meaning already specified above and $R^4$ represents a sulfo group, a sulfoalkyl group, a sulfophenyl group, a sulfoalkyl carbamoyl group, a sulfophenyl carbamoyl group or a sulfoalkoxycarbonyl group in which groups the alkyl portion thereof preferably contains from 1 to 4 carbon atoms; and u has a value from 0 to 10 mol %.

The residues $R^1$ which repeatedly occur in the monomers carrying the various indices x, y and z need not necessarily all have the same meaning but may differ from each other.

The residue $R^3$ represented in the above formula is the residue of a monomeric cross-linking compound. This means, in the context of this invention, polyfunctional monomeric compounds which contain at least two, occasionally three or more double bonds capable of copolymerising with acrylic acid or methacrylic acid, which monomeric compounds are built into various copolymer chains by means of the numerous copolymerisable double bonds present, thereby effecting cross-linking of the copolymers. Examples of suitable cross-linking compounds include divinyl cyclohexane, trivinylcyclohexane, divinylbenzene, 1,7-octadiene and others described in "Houben Weyl, Methoden der Organischen Chemie, Makromolekulare Stoffe, Part 1, Georg Thieme Verlag, Stuttgart, 1961, pages 32, 33."

The residue $R^4$ represented in the above formula is the residue of a copolymerisable monomeric unit containing a copolymerisable carbon-carbon double bond and a sulfonic acid group. The presence of such sulfo group-containing monomeric units exert a stabilising effect on the latex polymers and is in particular most useful when the emulsion polymerisation is performed starting directly with the free (meth-)acrylic acid instead of the corresponding esters. Representative examples of copolymerisable monomeric compounds containing a sulfo group which can be used in the preparation of the latex copolymers of the present invention include sulfostyrene, sulfoethyl (meth-)acrylate, sulfopropyl (meth-)acrylate, (meth-)acrylamido benzene sulfonic acid, allyl sulfonic acid, vinyl sulfonic acid and 2-acrylamido-2-methyl-propan sulfonic acid and salts thereof.

The following are examples of copolymers suitable according to the invention for the preparation of the neutralisation layer:

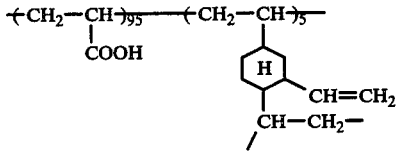

-continued

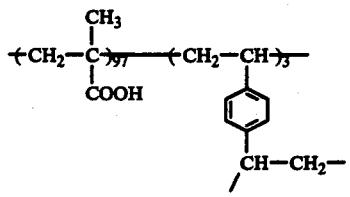

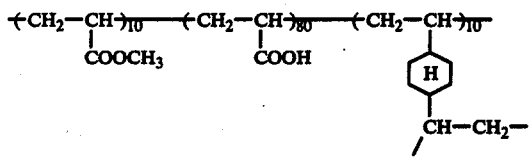

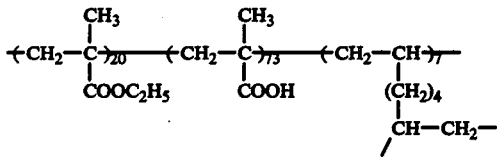

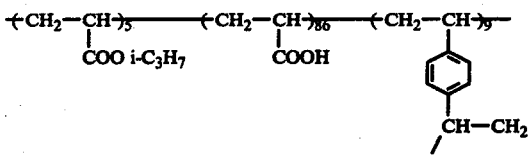

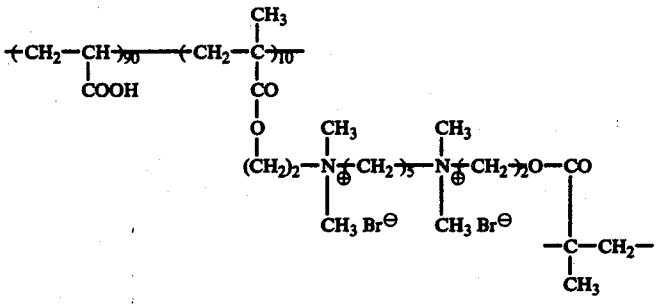

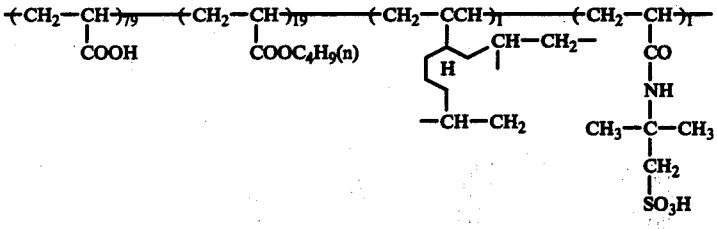

The polymer dispersions which may be used according to the invention are latices having an average particle size of less than 10 μm, preferably less than 1 μm. They are copolymers which can be dispersed in water but, in contrast to linear acrylic acid polymers, are insoluble in water due to the presence of the cross-linking compounds incorporated by polymerisation and they undergo little or no swelling. The degree of swelling can be controlled by varying the proportion of cross-linking compound.

The copolymers according to the invention may be prepared by the usual emulsion polymerisation processes, for example by emulsion polymerisation of an acrylic acid ester with divinylbenzene, suitably in the presence of an anionic surface-active compound such as sodium dodecyldiphenylether disulphonate, sodium lauryl sulphonate or a sulphonated condensate of an alkyl phenol-ethylene oxide condensate. Radical formers are suitably used as polymerisation initiators, for example initiators of the Redox type which form free radicals, such as potassium persulphate-sodium metabisulphite; potassium persulphate-$Fe^{2+}$ or tertiary butyl peroxide-ascorbic acid. Suitable methods include, for example those described in "Friedrich Hölscher, Dispersionen synthetischer Hochpolymerer, part 1, Springer Verlag, Berlin, Heidelberg, New York 1969, p. 43 pp".

Reference is also made to E. W. Duck, "Emulsion Polymerisation" in Encyclopedia of Polymer Science and Technology, Interscience Publishers, New York 1966.

The cross-linked polyacrylate latex obtained in this process may then be completely or partially saponified with an alkaline medium, e.g. with sodium or potassium hydroxide, and converted into the required acid form by ion exchange. This ion exchange may be carried out in the usual manner with an ion exchanger in the H-form or by acidification of the dispersion with any acid which does not cause coagulation of the latex, e.g. acetic acid, citric acid, oxalic acid or others, followed by dialysis of the dispersion. Depending on whether saponification was complete or partial, the carboxyl groups in the resulting cross-linked polyacrylic acid dispersion are no longer or only in part esterified. The more complete the saponification reaction has been, the greater is, of course, the capacity of the copolymer for neutralisation. However, for the purpose of influencing the mechanical properties of the neutralisation layer, such as its strength, elasticity and adherence to adjacent layers, it may be desirable to preserve a certain proportion of acrylic or methacrylic acid ester in the copolymer and therefore not to carry saponification to completion.

Instead of obtaining the latex copolymers in a two-step method by first copolymerising a mixture of (meth-)acrylic ester and the crosslinking agent and thereafter in a second step completely or partially saponifying the ester to the free acid the copolymers may advantageously also prepared in a one-step emulsion polymerisation method starting with a mixture of the free (meth-)acrylic acid and the cross-linking agent and optionally other copolymerisable monomers such as (meth-)acrylic acid esters and sulfo group-containing copolymerisable monomers. In this case it is of particular advantage to bring about the polymerisation reaction in the presence of small amounts (f.e. 0.1 to 10 mol %) of the latter mentioned copolymerisable monomers containing a sulfo group. By the addition of such monomers the stability of the polymer dispersion is substantially increased and it is even possible to perform the emulsion polymerisation in the absence of the surface-active compounds mentioned above. The latex particles are sufficiently stabilised by the copolymerised sulfonic acids.

Another process for preparing the copolymers consists of carrying out a water-in-oil polymerisation, in which an aqueous solution of a mixture of (meth)acrylic acid and cross-linking compound is polymerised in the presence of an anionic surface-active compound, for example, sorbitol monostearate, in a liquid which is immiscible with water, for example decalin or ligroin. Other reaction conditions may also be employed, for example those described in "J. W. Vanderhoff et al. 'Inverse Emulsion Polymerisation' in Polymerisation and Polycondensation Processes, Advances in Chemistry Series, American Chemical Society, USA 1962, No. 34, page 32".

The polymer dispersions obtained as described above may be used as such or they may first be converted into aqueous dispersions by flocculating the copolymer with methanol or hydrochloric acid, washing with acetone and redispersing in water by vigorous stirring.

Bifunctional, trifunctional or polyfunctional water-soluble monomers may be used as cross-linking compounds, for example those described in "A. Rembaum et al. Polymer Letters Vol. 7, page 395 (1969)".

The water dispersible copolymers used according to the invention generally have a particle size of from 0.04μ to 1μ, preferably from 0.06μ to 0.6μ. By "water dispersible copolymers" are meant polymers which form solutions which appear clear or milky cloudy to the naked eye but are found to contain dispersed particles when viewed under the electron microscope.

The cross-linked acrylic acid and methacrylic acid copolymers according to the invention have the advantage that they can be cast from a purely aqueous phase to form optically clear neutralisation layers which undergo little or no swelling. They have a high capacity for neutralisation, comparable to that of acrylic acid polymers which have not been cross-linked; this has an advantageous effect on the thickness of the layer required. When the neutralisation layer according to the invention is coated with dispersions for the barrier layer (barrier layer latices), difficulties such as shrinkage, formation of a skin and drying problems of the kind encountered when coating the known water-soluble neutralisation layers do not occur or only occur to a very reduced extent.

The neutralisation system consisting of the neutralisation layer according to the invention and the barrier layer may be used in an image receiving sheet for the dye diffusion transfer process if the image receiving sheet is separated from the light sensitive element after development. However, the preferred and main application of this neutralisation system lies in its use in dye diffusion transfer materials of the integral type, i.e. in monosheet materials in which no means are provided for separating the image receiving element from the light-sensitive element.

A monosheet material suitable for carrying out the dye diffusion transfer process according to the present invention may comprise, for example, the following layer elements:

(1) a transparent support layer,
(2) an image receiving layer,
(3) a light impervious layer,
(4) a light sensitive element having at least one light-sensitive silver halide emulsion layer and at least one dye-providing compound associated therewith,
(5) a barrier layer,
(6) an acid polymer layer (neutralisation layer),
(7) a transparent support layer.

The monosheet material may be composed of two parts which are prepared separately, the light-sensitive part (layer elements 1 to 4) and the cover sheet (layer elements 5 to 7), these two parts being then placed together with their active surfaces facing and joined together, optionally with the interposition of spacer strips to leave space for an accurately measured quantity of processing liquid between the two parts. The layer elements 5 and 6 which together form the neutralisation element may also be arranged additionally or alternatively between the support layer 1) and the image receiving layer 2) of the light-sensitive part, but, in that case, in reversed sequence.

Means may be provided for introducing a processing liquid between two adjacent layers of the monosheet material, for example in the form of a reparable container arranged at the side of the monosheet material so that, when it is subjected to mechanical forces, it releases its contents between two adjacent layers of the monosheet material, in the present case between the light-sensitive part and the cover sheet.

The alkaline processing phase adjusts the light-sensitive material to a relatively high pH, approximately 11 to 14, whereby development and imagewise dye diffusion are released. It has been found that the dyes and the layer combinations and hence the images obtained are not particularly stable at this high pH. It is therefore necessary to adjust the material to almost neutral or slightly acid after development has been completed. This is achieved in known manner by providing the material with an additional layer of acid polymer (neutralisation layer) which only gradually becomes accessible to the alkaline processing substance during development. A neutralisation layer for the purpose of this invention is a layer containing an acrylic acid or methacrylic acid copolymer which has been cross-linked by copolymerisation with a cross-linking compound. The acid groups (carboxyl groups) react with the cations of the processing substance under salt formation, thus lowering the pH of the substance.

The acid polymer layer according to the invention (neutralisation layer) contains sufficient acid groups to lower the pH of the processing substance from an initial value of from 11 to 14 to an almost neutral or slightly acid pH at the end (pH 5 to 8).

The copolymer dispersions according to the invention may, of course, be mixed with other, known latices. For example, the copolymer according to the invention may be mixed with small quantities of a butyl acrylate latex to increase the elasticity of the acid polymer layer (neutralisation layer). The addition of small quantities of a polyglycidyl methacrylate latex results in additional cross-linking of the dispersion particles according to the invention so that a firmer neutralisation layer is obtained. The adherence to adjacent layers in the combination can be improved by the addition of other dispersions.

The time delay in the reduction in pH may be achieved in known manner by coating the acid polymer layer with a so-called barrier layer. This layer contains a polymer which has delayed permeability to diffusible alkali so that lowering of the pH occurs with some delay. Together with the acid polymer layer, this barrier layer forms the neutralisation element of the present invention. It is clear that the barrier layer must be arranged between the acid polymer layer and the image receiving layer within the layer combination. The barrier layer according to the invention is preferably prepared by casting the corresponding polymer from aqueous solution and then drying. The thickness of the barrier layer depends on the desired delay time (development time) and is generally between 2 and 20μ.

An important part of the photographic material according to the present invention is the light-sensitive element which, in the case of a monochrome transfer process, contains a light-sensitive silver halide emulsion layer and a dye-providing compound associated therewith. This dye-providing compound may be situated in a layer adjacent to the aforesaid silver halide emulsion layer or in the silver halide emulsion layer itself. In the latter case, the colour of the image dye is preferably chosen so that the predominant absorption range of the dye-providing compound does not correspond with the predominant sensitivity range of the silver halide emulsion layer. For producing multicoloured transfer images in colours true to life, the light-sensitive element contains three such associations of dye-providing compound with light-sensitive halide emulsion layer. As a rule, the absorption range of the dye produced from the dye-providing compound in that case substantially corresponds to the region of spectral sensitivity of the associated silver halide emulsion layer. However, in order to obtain the highest possible sensitivity under these conditions, the dye-providing compound should be arranged in a separate layer of binder (viewed in the direction of incident light used for exposure) behind the silver halide emulsion layer.

The oxidation products produced from the developer during development of the silver halide emulsion must, of course, only affect the associated dye-providing compound. The light-sensitive element is therefore generally provided with separating layers which effectively prevent diffusion of the developer oxidation products into other layers not associated with the given dye-providing compound. These separating layers may, for example, contain suitable substances which react with the developer oxidation products, for example they may contain non-diffusible hydroquinone derivatives or, if the developer compound is a colour developer compound, they may contain non-diffusible colour couplers.

The light-sensitive element contains substances which are capable of forming an imagewise distribution of a diffusible image dye during development. These substances are present either in the silver halide emulsion layers or in an adjacent layer. They will hereinafter be referred to as dye-providing compounds. They may be compounds of any kind which give rise to diffusible dyes during development of the light-sensitive element. They may be coloured compounds which are diffusible and begin to diffuse when the layers are treated with an alkaline processing liquid and are subsequently fixed by development only in the exposed areas. Alternatively, the dye-providing compounds may be resistant to diffusion and release a diffusible dye during development.

Dye-providing compounds which are diffusible initially have been disclosed, for example, in German Pat. Nos. 1,036,640; 1,111,936 and 1,196,075. The so-called dye developers described in the said Patent Specifications contain, in one and the same molecule, a dye residue and a group which is capable of developing exposed silver halide.

Among the previously known methods of producing coloured photographic images by the dye diffusion transfer process, those which are based on the use of dye-providing compounds which are incorporated in a diffusion resistant form and from which the process of development releases an imagewise distribution of diffusible dyes or dye precursors which are transferred to an image receiving layer have become increasingly important in recent times.

Among the dye-providing compounds suitable for these processes should be included the non-diffusible colour couplers described in German Pat. No. 1,095,115 or in the corresponding U.S. Pat. No. 3,227,550, which react with the oxidation product of a colour developer compound consisting of a primary aromatic amine to release in a diffusible form a dye which has either been preformed or produced in the colour coupling reaction. The choice of suitable developer compounds is, of course, restricted to colour developers.

Reference may also be had in this connection to the non-diffusible dye-providing compounds described in German Offenlegungsschrift No. 1,930,215 or in the corresponding U.S. Pat. No. 3,628,952 in which a preformed dye residue which is latently diffusible is linked to a residue which confers diffusion resistance by a hydrazone group which can be split off. These compounds should not be regarded as colour couplers and it has been found that the choice of developer compounds suitable for releasing the diffusible dye residue is by no means restricted to the usual colour developers but may well be extended to black and white developers, e.g. pyrocatechols.

In German Offenlegungsschrift No. 1,772,929, there have been described non-diffusible coloured compounds having a special grouping, which undergo an oxidative ring closure reaction in the development process to release a preformed dye residue in a diffusible form. The compounds presented in the said Offenlegungsschrift may be divided into two groups. The compounds of one group require conventional colour developer compounds for development. They undergo a coupling reaction with the oxidation products of these colour developer compounds and release the preformed dye residue in a diffusible form in a subsequent ring closure reaction. The compounds of the other group themselves act as silver halide developers and are therefore capable, when in their oxidized form of entering into the above mentioned ring closure reaction to release the diffusible dyes even in the absence of any other developer compounds.

The non-diffusible dye-providing compounds described in German Offenlegungsschrift No. 2,242,762 should also be mentioned at this point. These are sulphonamidophenols and sulphonamidoanilines which are split by means of the alkali in the developer after the oxidation reaction of development, thereby releasing diffusible dyes.

The non-diffusible dye-providing compounds described in German Offenlegungsschrift No. 2,505,248 and in German Offenlegungsschrift No. 2,645,656, e.g. 3-sulphonamido indole derivatives, also undergo a similar reaction. The research disclosure publications No. 13,024 (February 1975) and 15,654 (April 1977) should also be mentioned in this connection.

All the dye-providing compounds mentioned above function negatively, that is to say when conventional, negatively functioning silver halide emulsions are used, the imagewise distribution of the released diffusible dye corresponds with the negative silver image produced during development. To produce positive dye images, it is therefore necessary to use direct positive silver halide emulsions or to apply a suitable reversal process.

Such a reversal process is available in the form of the silver salt diffusion process. Photographic reversal by means of the silver salt diffusion process to produce positive coloured images by means of conventional colour couplers has been described, for example, in U.S. Pat. No. 2,763,800. By replacing the colour coupler by the above-mentioned dye-providing compounds, one obtains a light-sensitive element which is suitable for the dye diffusion transfer process. Such a light-sensitive element contains, for example, at least one combination of a light-sensitive silver halide emulsion layer and, associated with this layer, a layer of binder containing development nuclei for physical development and a dye-providing compound.

In the development process, the exposed areas of the silver halide in the light-sensitive silver halide emulsion layer undergo chemical development. The unexposed areas are transferred to the associated layer of binder which contains development nuclei by means of the silver halide solvent and physically developed in this layer of binder. If the developer used for physical development is one which in its oxidized form is capable of releasing a diffusible dye by a reaction with the dye-providing compound present in this layer, an imagewise distribution of diffusible dyes results, and these dyes may be transferred to an image receiving layer to form a positive coloured image there.

When compounds which release development inhibitors in imagewise distribution are used for the reversal process, the light-sensitive element consists of at least one layer combination of a light-sensitive silver halide emulsion layer and a second emulsion layer which is developable without exposure and contains the dye-providing compound. The light-sensitive silver halide emulsion layer may be developed, for example, with colour developers in the presence of certain compounds which react with oxidized colour developer to release development inhibiting substances. The development inhibiting substances released imagewise in the light-sensitive layer diffuse into the adjacent emulsion layer which is developable without exposure, where they inhibit development in areas corresponding to the image. The uninhibited (positive) areas of the emulsion layer which is developable without exposure are developed by the remainder of the developer, whose oxidation products then react with the non-diffusible, dye-providing compounds to release diffusible dyes which are transferred imagewise to the image receptor element. Suitable compounds which release development inhibiting substances in their reaction with oxidation products of colour developers include, for example, the known DIR couplers (DIR = development inhibitor releasing), which are colour couplers containing a releasable inhibitor residue in the coupling position. Such DIR couplers have been described, for example, in U.S. Pat. No. 3,227,554.

Another group of compounds which react with colour developer oxidation products to release development inhibiting substances has been described in U.S. Pat. No. 3,632,345. These compounds are not colour couplers. No dyes are therefore formed when the development inhibiting substances are released. Very similar compounds have also been described in German Offenlegungsschrift No. 2,359,295. Lastly, according to German Pat. No. 1,229,389, suitably substituted, non-diffusible hydroquinone compounds which react with developer oxidation products to be oxidized to the corresponding quinones and release development inhibiting mercaptans may be used in such a process.

The direct positive silver halide emulsions used may, in principle, be any direct positive silver halide emulsions which, when subjected to a simple development process, produce a positive silver image and a corresponding imagewise distribution of developer oxidation products. These include, for example, those silver halide emulsions in which exposure to light or chemical treatment has resulted in a developable fog which is destroyed imagewise when imagewise exposure is carried out under certain conditions. The fog is preserved in the areas which are not exposed by this imagewise exposure, so that subsequent development results in a direct positive silver image and a corresponding imagewise distribution of diffusible dye if a dye-providing compound has been associated with the direct positive silver halide emulsion.

Another group of direct positive silver halide emulsions which are used for preference according to the present invention includes the so-called unfogged direct positive silver halide emulsions which have a sensitivity to light predominantly located in the interior of the silver halide grains. When these emulsions are exposed imagewise, a latent image is formed predominantly in the interior of the silver halide grains. Development of such unfogged direct positive silver halide emulsions is carried out under fogging conditions, a fog being produced mainly in the unexposed areas, and a positive silver image is produced on development. The unfogged direct positive silver halide emulsions are characterised in that when exposed samples are developed with a typical surface developer having the following composition:

| | |
|---|---|
| p-Hydroxyphenylglycine | 10 g |
| Sodium carbonate (crystalline) | 100 g |
| made up with water to | 1000 ml |

they preferably from no silver image or only one of very low density, but when they are developed with an internal nuclear developer having the following composition:

| | |
|---|---|
| Hydroquinone | 15 g |
| Monomethyl-p-aminophenol sulphate | 15 g |
| Sodium sulphite (anhydrous) | 50 g |
| Potassium bromide | 10 g |
| Sodium hydroxide | 25 g |
| Sodium thiosulphate (crystalline) | 20 g |
| made up with water to | 1000 ml |

a silver image with sufficient density is produced.

Selective fogging of unfogged direct positive emulsions which have been exposed imagewise may be carried out before or during development, by treating the emulsions with a fogging agent. Reducing agents such as hydrazine or substituted hydrazines are suitable fogging agents. See, for example, U.S. Pat. No. 3,227,552.

Unfogged direct positive emulsions include, for example, those which have gaps in the interior of the silver halide grains as described in (U.S. Pat. No. 2,592,250) or silver halide emulsions which have a layered grain structure as described in German Offenlegungsschrift No. 2,308,239.

Positive colour transfer images may also be produced with the aid of the usual negative emulsions without a reversal process of the type described above, for example, if the dye-providing compounds used have a non-diffusible, oxidizable carrier residue which is released under the influence of the developer alkali only when it is in its non-oxidized form whereas in its oxidized form it undergoes molecular rearrangement which prevents or inhibits its release. Dye-providing compounds of this type have been described, for example in German Offenlegungsschriften Nos. 2,402,900 and 2,543,902.

The light impervious layer arranged under the light-sensitive element is permeable to aqueous alkaline treatment solutions and hence to diffusible dyes. It has two main functions. First, it serves to cover the image silver remaining in the original light-sensitive element after development as well as the dye-providing compounds left behind as colour negatives so that when the light sensitive element is viewed through its transparent support layer, only the positive transfer image is visible. Second, it shuts off light from the light-sensitive element on the side of the image receiving layer (from underneath). The latter is particularly important in cases where the monosheet material is brought into contact with the alkaline processing substances while still inside the camera after exposure and is then pulled out of the camera to be developed outside the camera.

Layers which are sufficiently impervious to light but sufficiently permeable to diffusible dyes can be prepared, for example, from suspensions of inorganic or organic dark pigments, preferably black pigments, for example suspensions of carbon black in suitable binders, e.g. in gelatine solutions. In order to ensure the necessary exclusion of light during development, it is generally sufficient to use layers from 0.5 to 2$\mu$ in thickness containing from 10 to 90% by weight, based on the total dry weight, of carbon black in gelatine. The particle size of the pigments used is relatively uncritical, provided it is not substantially above 0.5$\mu$.

In addition to the black pigment layer, the light impervious layer preferably has a white pigment layer arranged underneath it. The object of this white layer is to cover the black layer and provide a white background for the image. Any white pigments are suitable for this purpose, provided they have sufficient covering power in layers which are not too thick. Examples include barium sulphate, oxides of zinc, titanium, silicon, aluminium and zirconium, and barium stearate and kaolin. The white pigment preferably used is titanium dioxide. The same conditions apply as for the black pigment with regard to the binder, the concentration and the particle size. The thickness of the white pigment layer may be varied according to the desired degree of whiteness of the background. Thicknesses of between 2 and 20$\mu$ are preferably used.

Instead of containing the light impervious layer the monosheet material may, according to the present invention, contain means for producing such a light impervious layer between the light-sensitive element and the image receiving layer, for example in the form of a container containing a processing liquid with clouding agent (pigment) arranged at the side of the monosheet material so that when subjected to mechanical forces it releases its contents between the above mentioned layers to form such a pigment layer between them.

The image receiving layer consists basically of a binder containing dye mordants for fixing the diffusible acid dyes.

The mordants used for acid dyes are preferably long chain quaternary ammonium or phophonium compounds or tertiary sulphonium compounds, for example, those described in U.S. Pat. Nos. 3,271,147 and 3,271,148.

Certain metal salts and their hydroxides which form sparingly soluble compounds with acid dyes may also be used. The dye mordants in the receptor layer are dispersed in one of the usual hydrophilic binders, for example, in gelatine, polyvinylpyrrolidone or partially or completely hydrolysed cellulose esters. Some binders may, of course, also function as mordants, for example copolymers or polymer mixtures of vinyl alcohol and N-vinylpyrrolidone, for example as described in German Auslegeschrift No. 1,130,284, or binders which consist of polymers of quaternary nitrogen bases, for example polymers of N-methyl-2-vinylpyridine, as described, for example, in U.S. Pat. No. 2,484,430. Other suitable mordanting binders include, for example, guanyl hydrazone derivatives of alkyl vinyl ketone polymers, e.g. as described in U.S. Pat. No. 2,882,156, or guanylhydrazone derivatives of acyl styrene polymers, e.g. as described in German Offenlegungsschrift No. 2,009,498.

As a general rule, however, the last mentioned binders would be used in combination with other binders, e.g. gelatine.

The transparent support layers used for the monosheet material according to the invention may be any of the usual transparent support materials used in photographic practice, e.g. films of cellulose esters, polyethylene terephthalate, polycarbonate or other film-forming polymers.

To process the light-sensitive element, it is treated with an aqueous alkaline developer preparation after imagewise exposure, and brought into contact with the image receptor element. In the case of monosheet materials, the developer preparation is forced between two layers of the monosheet. The developer preparation may contain developer compounds in addition to the aqueous alkali, but these developer compounds must be adjusted to the nature of the colour producing compounds. Other possible constituents of the developer preparation include thickeners for increasing the viscosity, such as hydroxyethylcellulose, silver halide solvents such as sodium thiosulphate or one of the bis-sulphonylalkane compounds described in German Offenlegungsschrift No. 2,126,661, and clouding agents for producing opaque layers, e.g. pigments of $TiO_2$, ZnO, barium stearate or kaolin. Some of these constituents may be incorporated in one or more layers of the monosheet materials instead of or in addition to being contained in the developer preparations. Thus, for example, according to one particularly preferred embodiment, non-diffusible developer compounds are incorporated in layers of the light-sensitive element while the developer preparation itself contains only small quantities of a diffusible auxiliary developer compound. Information on this may be found, for example, in German Offenlegungsschriften Nos. 2,327,963 and 2,335,179.

EXAMPLES OF PREPARATION

Example 1

(A) 23 g of a 45% aqueous solution of sodium dodecyl diphenyl ether disulphonate were added to 3400 g of deionised water under a protective atmosphere of nitrogen. 200 g of a monomer mixture of 1245 g of methyl acrylate and 100 g of freshly distilled trivinylcyclohexane were then added at 75° C. with vigorous stirring. 88 g of a solution of 8.25 g of potassium peroxydisulphate in 260 g of water (initiator solution) were added 10 minutes later, and the remainder of the monomer mixture was then added at 80 to 83° C. together with the remainder of the initiator solution. A solution of 800 mg of tertiary butyl hydroperoxide and 440 mg of sodium dodecyl diphenyl ether disulphonate in 4.5 g of distilled water and a solution of 800 mg of ascorbic acid in 87 g of distilled water were added to this mixture after 30 minutes and the resulting mixture was stirred for a further 2 hours at 80 to 83° C. Small quantities of precipitated polymer were filtered off.

(B) 101 g of potassium hydroxide in 4000 go of distilled water were added to 2560 g of the latex prepared according to (A). After 7 hours' stirring, a further 223 g of potassium hydroxide in 875 ml of water were added, whereupon the mixture was stirred at boiling point for a further 20 hours, until the pH was 10. The resulting latex contained the acrylate units in the form of the potassium salt. 2000 g of glacial acetic acid were added and the latex was displayed with running water for 24 hours. The cross-linked latex obtained consisted of cross-linked polymer chains having acrylic acid units, and it contained polymer particles having a diameter of less than 0.4 $\mu$m.

Examples 2 and 3

Other cross-linked latices were prepared by the method described in Example 1, using divinylbenzene or 1,7-octadiene instead of trivinylcyclohexane.

Examples 4 and 5

Other cross-linked latices were prepared by the method described in Example 1. In Example 4, saponification was carried out with 200 g of potassium hydroxide, and in Example 5 with 180 g of potassium hydroxide.

Examples 6 and 7

Other cross-linked latices were prepared by the process described in Example 1. In Example 6, ethyl acrylate was used instead of methyl acrylate, and in Example 7 ethylmethacrylate was used.

Examples 8 to 14

Latices were prepared by the process described in Examples 1 to 7 but the salt form of the dispersion was converted into the acid form by means of a cation exchanger present in the H-form.

Example 15

(A) A solution of 1100 g of water and 7 ml of a 45% aqueous solution of sodium dodecyldiphenylether disulphonate was heated to 50° C. under an atmosphere of nitrogen. 5 g of potassium peroxydisulphate and 9 g of sodium hydrogen sulphite were added. When the salts had dissolved, 15% of a solution of 190 g of tert.-butyl acrylate and 10 g of trivinylcyclohexane were added. The remainder of the monomer solution was then added dropwise in the course of 2 hours. The reaction mixture was filtered after 2 hours' stirring at 50° C. A latex having a solid content of 14% was obtained.

(B) 500 g of the latex prepared as described under (A) were acidified with 5 ml of glacial acetic acid and then steam distilled for 30 hours to distil off the products of hydrolysis. A cross-linked latex containing acrylic acid units was obtained after filtration.

Examples 16 to 18

Other latices were prepared by the same method as that described in Example 15 except that in Example 16 10 g of the tertiary butyl acrylate were replaced by acrylic acid and in Example 17, 20 g of the tert.-butyl acrylate were replaced by acrylic acid, and in Example 18, 30 g of tertiary butyl acrylate were replaced by methacrylic acid.

Example 19

Three solutions (A,B,C) were prepared as follows:

A: 68 g of acrylic acid, 30 g butyl acrylate and 2 g of 1,2,4-Trisvinyl-cyclohexane.

B: 1 g of potassium persulphate in 300 ml of deionised water.

C: 1 g of sodium metabisulphite and 2 g of 2-acrylamido-2-methyl-propane sulphonic acid in 300 ml of deionised water.

10% of each of the solution are placed together in a reaction vessel and are rapidly heated with stirring to 95° C. To this mixture the remaining parts of the solutions A,B and C are added dropwise simultaneously and continuously within 2 hours, such that the temperature is kept at 90 to 95° C. Stirring is then continued for 4 hours. On cooling the dispersion is filtered to remove small amounts of coagulated copolymer.

EXAMPLES OF APPLICATION

Example 20

The light-sensitive element of a photographic material according to the invention was prepared by applying the following layers in succession to a 180μ thick transparent support in the form of a polyester foil. The quantities given are based on 1 $m^2$. The structural formulae of the compounds are found in the annexe after Example 1.

(1) A mordant layer of 5.7 g of a polyurethane of 4,4'-diphenylmethane-diisocyanate and N-ethyldiethanolamine quaternised with epichlorohydrin and 5.8 g of gelatine;
(2) a reflection layer of 27 g of titanium dioxide and 2.7 g of gelatine;
(3) a carbon black layer of 1.85 g of carbon black and 2 g of gelatine;
(4) a dye layer consisting of 0.6 g of compound (A) which yields a cyan dye, 35 mg of octadecylhydroquinone sulphonic acid and 0.9 g of gelatine;
(5) a red-sensitized emulsion layer containing an unfogged direct positive silver chlorobromide emulsion, silver application (Ag) 1.7 g, 66 mg of octadecylhydroquinone sulphonic acid, solution of compound D (fogging agent) and 1.3 g of gelatine;
(6) a trapping layer for oxidized developer, consisting of 0.53 g of octadecylhydroquinone sulphonic acid and 2.7 g of gelatine;
(7) a dye layer consisting of 1.0 g of compound B which yields a magenta dye, 40 mg of octadecylhydroquinone sulphonic acid and 1.0 g of gelatine;
(8) a green sensitized emulsion layer containing an unfogged direct positive silver chlorobromide emulsion, silver application 1.7 g, 66 mg of octadecylhydroquinone sulphonic acid, 40 mg of compound D (fogging agent) and 1.3 g of gelatine;
(9) a trapping layer for oxidized developer, identical to layer 6);
(10) a dye layer consisting of 1.0 g of compound C which yields a yellow dye, and 1.0 g of gelatine;
(11) a blue sensitized emulsion layer containing an unfogged, direct positive silver chlorobromide emulsion, silver application 1.7 g, 66 mg of octadecylhydroquinone sulphonic acid, 40 mg of compound D (fogging agent) and 1.3 g of gelatine;
(12) a protective layer of 0.8 g of gelatine containing 0.8 g of N-methyl-N'-(3-dimethylamino)-propylcarbodiimide hydrochloride (hardener).

The neutralisation system was prepared by applying the following layers in succession to a transparent support in the form of a 100μ thick polyester foil:

(1) Neutralisation layer prepared by casting a latex prepared according to Example of preparation 1 to form a layer having a thickness of 15 μm when dry;
(2) barrier layer prepared by applying a mixture having the following composition:

| | |
|---|---|
| Cellulose acetate (containing 40 % acetyl) (Cellit F, product of Bayer AG, Leverkusen) | 4.0 g |
| Copolymer of styrene and maleic acid anhydride (molar ratio of mixture 1:1) | 0.2 g |
| Acetone | 83.0 ml |
| Methanol | 17.0 ml |
| Fluortensid FC 430 (Trade product of 3 M Corporation) 10 % in acetone | 1.5 ml |

to form a layer having a thickness when dry of 4.7 μm.

A sheet of the light-sensitive element and a sheet of the neutralisation system were joined together with their active surfaces facing each other by two laterally placed spacer strips 140 μm in thickness. A bag containing developer paste was placed at one end and a receiver for excess developer at the other end. The set formed in this way was exposed through an exposure original (grey wedge and colour separations) and then passed between a pair of squeezing rollers so that the developer paste was distributed between the light-sensitive element and the neutralisation system. The developer paste had the following composition:

10 ml of benzyl alcohol
3 g of 5-methyl-benzotriazole
42 g of Natrosol HHR (hydroxyethyl cellulose — Trade product of Hercules Power Company)
6 g of 4-methyl-4-hydroxymethylphenidone
6.1 g of hydroquinone
110.0 g of carbon black
70.0 g of potassium hydroxide
1.0 g of sodium sulphate made up to 1 liter with water.

At the end of the development time, a positive copy of the original with very good colour reproduction could be seen through the transparent substrate, the $TiO_2$ layer serving as background.

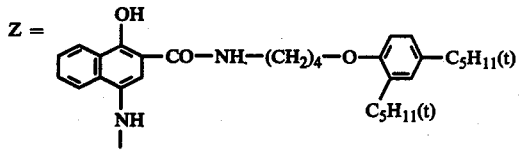

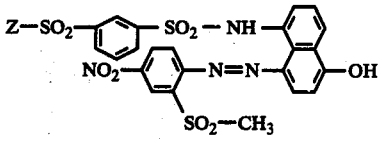

Compound A

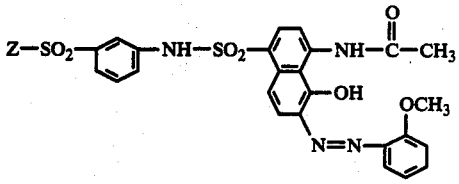

Compound B

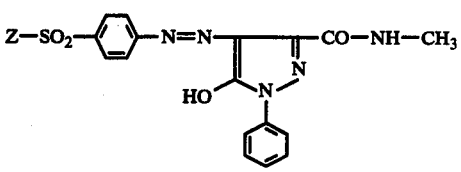

Compound C

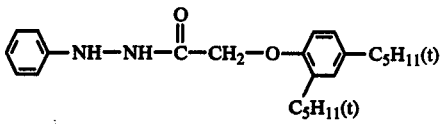

Verbindung D

Example 21

Equally good results, with all technical advantages of a neutralisation system which can be cast from a purely aqueous phase are obtained if the barrier layer used is one prepared from a tetrapolymer latex of butyl acrylate/diacetone acrylamide/styrene/methacrylic acid in molar ratios of 60/30/4/6 mixed with polyacrylamide in proportions of 40:1 according to German Offenlegungsschrift No. 2,319,723, page 29. When, however, this barrier layer is applied to a neutralisation layer according to U.S. Pat. No. 3,756,815, consisting of a water-soluble polymeric acid and a hydrophilic binder, shrinkage of the barrier layer and formation of a skin are observed due to the severe and rapid swelling of the neutralisation layer. This renders further drying of the layer combination very difficult and leads to severe structural defects in the layers, rendering practical application of such neutralisation elements impossible.

We claim:

1. A photographic film unit for the production of colored transfer images, comprising a dimensionally stable layer support, an image receptor layer, a light-sensitive element having at least one light-sensitive silver halide emulsion layer and a non-diffusible dye-providing compound associated therewith, and a neutralisation system consisting of a neutralisation layer having a polymer which contains free acid groups and a barrier layer which retards neutralisation, said neutralisation system being located on one side of a laminate consisting of said light sensitive element and said image receptor layer with said barrier layer of said system arranged between said laminate and said neutralisation layer, wherein the improvement comprises the neutralisation layer contains a crosslinked copolymer consisting of 30 to 99 mol % of copolymerized acrylic acid or methacrylic acid units and 1 to 30 mol % of copolymerized units of a cross-linking agent having at least two copolymerizable carbon-carbon double bonds, the balance being copolymerised units selected from the group consisting of copolymerizable monomeric compounds containing a copolymerizable carbon-carbon-double bond and a sulfonic acid group and copolymerizable monomeric compounds free from acid groups, selected from alkyl acrylates, cycloalkyl acrylates, alkyl methacrylates and cycloalkyl methacrylates, said copolymer being crosslinked through said cross-linking agent having at least two copolymerizable double bonds.

2. Film unit as claimed in claim 1, wherein said copolymer corresponds to the following formula:

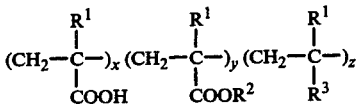

wherein $R^1$ represents hydrogen or methyl, $R^2$ represents alkyl having from 1 to 4 C atoms or cycloalkyl, $R^3$ represents the residue of the said organic cross-linking compound and has at least one copolymerized carbon-carbon double bond, x, y, z represent the molar proportions of copolymerized monomers in the copolymer (in mol %) as follows:

x = 30 to 99 mol %, y+z = 1 to 70 mol %, where y represents 0 to 69 mol % and z represents 1 to 30 mol %.

3. Film unit as claimed in claim 2 wherein said copolymer corresponds to the following formula

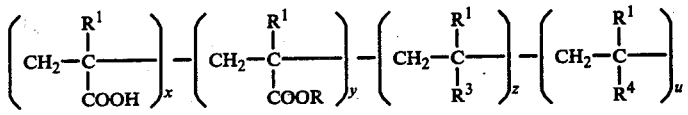

wherein $R^1$, $R^2$, $R^3$, x, y and z have the meaning specified in claim 2 and $R_4$ represents a sulfo group, a sulfoalkyl group, a sulfophenyl group, a sulfoalkyl carbamoyl group, a sulfophenylcarbamoyl group or a sulfoalkoxycarbonyl group in which groups the alkyl portion thereof contains from 1 to 4 carbon atoms; and u has a value from 0 to 10 mol %.

4. Film unit as claimed in claim 1, in which the neutralisation layer was applied from the aqueous phase in the form of a latex (aqueous dispersion) of said cross-linked acrylic or methacrylic acid copolymer which has 30 to 99 mol % of copolymerized acrylic acid or methacrylic acid units and 1 to 70 mol % of copolymerized units of a crosslinking agent having at least two copolymerizable carbon-carbon double bonds.

* * * * *